US011571797B1

(12) United States Patent
Sun

(10) Patent No.: US 11,571,797 B1
(45) Date of Patent: Feb. 7, 2023

(54) PNEUMATIC IMPACT TOOL HAVING VIBRATION REDUCING STRUCTURE

(71) Applicant: STORM PNEUMATIC TOOL CO., LTD., Taichung (TW)

(72) Inventor: Yung Yung Sun, Taichung (TW)

(73) Assignee: STORM PNEUMATIC TOOL CO., LTD., Taichung (TW)

( * ) Notice: Subject to any disclaimer, the term of this patent is extended or adjusted under 35 U.S.C. 154(b) by 0 days.

(21) Appl. No.: 17/669,709

(22) Filed: Feb. 11, 2022

(51) Int. Cl.
*B25D 9/04* (2006.01)
*B25D 17/02* (2006.01)
*B25D 17/24* (2006.01)

(52) U.S. Cl.
CPC .... *B25D 17/245* (2013.01); *B25D 2217/0073* (2013.01); *B25D 2250/181* (2013.01)

(58) Field of Classification Search
CPC ..... B25D 9/08; B25D 2250/371; B25D 9/04; B25D 17/24; B25D 17/245; B25D 2217/0073; B25D 2250/181
USPC ..... 173/210
See application file for complete search history.

(56) References Cited

U.S. PATENT DOCUMENTS

2017/0291291 A1* 10/2017 Chen ..... B25F 5/02
2020/0230795 A1* 7/2020 Carlson ..... B25C 1/047

FOREIGN PATENT DOCUMENTS

TW 235700 B1 * 7/2005
TW I235700 B 7/2005
TW I729809 B 6/2021

* cited by examiner

*Primary Examiner* — Andrew M Tecco
*Assistant Examiner* — Jacob A Smith
(74) *Attorney, Agent, or Firm* — Muncy, Geissler, Olds & Lowe, P.C.

(57) ABSTRACT

A pneumatic impact tool having a vibration reducing structure includes a handle with a bucket member and a directional control valve. A tube member including a cylindrical wall and a chamber is coupled with the bucket member. The chamber is divided into a front and a rear chamber portion by a hammer member. Gas may be guided into the front or the rear chamber portion by the directional control valve. A vent is disposed on the cylindrical wall. An exhaust channel which communicates with the front chamber portion and not communicates with the rear chamber portion is disposed on an outer peripheral surface of the hammer member. The hammer member is pushed to return if gas is guided into the front chamber portion. Gas in the front chamber portion is exhausted when the exhaust channel communicates with the vent.

10 Claims, 12 Drawing Sheets

PNEUMATIC IMPACT TOOL HAVING VIBRATION REDUCING STRUCTURE

BACKGROUND OF THE INVENTION

1. Technical Field

The present invention relates to a handheld tool and more particularly to a pneumatic impact tool.

2. Description of Related Art

Vibration is generated in the course of using a pneumatic hammer due to the reciprocating movement of the hammer member, which has a bad effect upon user's hand that grasps the pneumatic hammer. The stronger the hitting power of the pneumatic hammer is, the greater the vibration is generated, so the pneumatic hammer should be improved.

Each of conventional pneumatic hammers disclosed in Taiwan Patent No. 1235700 and 1729809 mainly includes a space filled with gas at a rear end of a barrel to cushion the vibration generated by returning movement of the hammer member. Another conventional pneumatic hammer disclosed in FIG. 4 of Taiwan Patent No. 1729809 includes a spring or a rubber chunk disposed at a rear end of a barrel to cushion the vibration when compressed.

Both the conventional pneumatic hammers above-mentioned cushion vibration by additional components, such as a space filled with gas, a spring or a rubber chunk, after the vibration has been generated. In addition to the disadvantage of increased cost, it is not efficient enough to reduce vibration, and the user still feels discomfort in the hands during operation.

A structure disclosed in FIG. 5 of Taiwan Patent No. 1235700 includes a gas channel connected to a front end of a barrel. Gas is guided into the barrel through the gas channel to push the hammer member that has arrived at the front end of a barrel to return. A vent for exhausting is provided in a middle position of the barrel. Thus, in the course of the hammer member hitting the tool and then rebounding, gas can be exhausted only after the hammer member passes the vent. Gas, however, has driven the hammer member by its high pressure to move with a high speed and then hit the rear end of the barrel. That is why the pneumatic hammer vibrates.

BRIEF SUMMARY OF THE INVENTION

The primary objective of the present invention is to provide a pneumatic impact tool featuring in that the hammer member is provided with an exhaust channel in communication with the front chamber portion of the tube member so that gas is exhausted at the beginning of the returning process of the hammer member, and thus a force pushing the hammer member to return is weakened to reduce vibration.

To achieve the above objective, the present invention provides a pneumatic impact tool having a vibration reducing structure including a handle with a recess and a gas supplying channel communicated with the recess, the gas supplying channel being provided with a gas switch. A bucket member is accommodated in the recess. A communicating hole is disposed on a side wall of the bucket member for guiding high pressure gas from the gas supplying channel into a directional control valve fixed in the bucket member. A tube member includes a cylindrical wall coupled with the bucket member and a chamber surrounded by the cylindrical wall. The chamber is divided into a front chamber portion and a rear chamber portion by a hammer member which is disposed in the chamber and closely engaged with the cylindrical wall. A tool member is disposed at a front end of the cylindrical wall while at least one vent is disposed on the cylindrical wall to communicate the chamber to an environment. A gas passing channel communicating the directional control valve and the front chamber portion is disposed in the cylindrical wall. The gas passing channel has a first gas inlet which is formed within the front chamber portion. A second gas inlet in communication with the directional control valve is provided within the rear chamber portion. Gas may be selectively guided into the front chamber portion through the first gas inlet or into the rear chamber portion through the second gas inlet. An exhaust channel is disposed on an outer peripheral surface of the hammer member. The hammer member includes a head portion close to the first gas inlet and a tail portion close to the second gas inlet. The exhaust channel extends to the head portion to be in communication with the front chamber portion, along with that the exhaust channel does not extend to the tail portion so as to lack in communication with the rear chamber portion. The hammer member is pushed by high pressure gas to move toward the tool member if high pressure gas is guided into the rear chamber portion through the second gas inlet. The hammer member is pushed by high pressure gas to move away from the tool member if high pressure gas is guided into the front chamber portion through the first gas inlet. Gas in the front chamber portion is exhausted through the exhaust channel and the at least one vent to lower a force pushing the hammer member when the exhaust channel communicates with the at least one vent.

In one embodiment, the exhaust channel is formed as a helical groove disposed on the outer peripheral surface of the hammer member.

Preferably, the groove communicates with the at least one vent when the hammer member engages with the tool member.

Preferably, three said vents with different distances to the tool member are disposed on the cylindrical wall. The groove communicates with one said vent which is closest to the tool member and one next said vent when the hammer member is at a position where to engage with the tool member.

In another embodiment, the exhaust channel includes a groove portion and a cylindrical gap in communication with each other, the groove portion extending in a straight direction parallel to a moving direction of the hammer member to the head portion to be in communication with the front chamber portion, the cylindrical gap being formed as a space between a concave portion disposed on the outer peripheral surface of the hammer member and the cylindrical wall.

Preferably, the cylindrical gap communicates with the at least one vent when the hammer member engages with the tool member.

Preferably, three said vents with different distances to the tool member are disposed on the cylindrical wall. The cylindrical gap communicates with one said vent which is closest to the tool member and one next said vent when the hammer member is at a position where to engage with the tool member.

Preferably, a distance between the at least one vent and the tool member is not greater than half a length of the chamber.

DETAILED DESCRIPTION OF THE INVENTION

Figure 1:
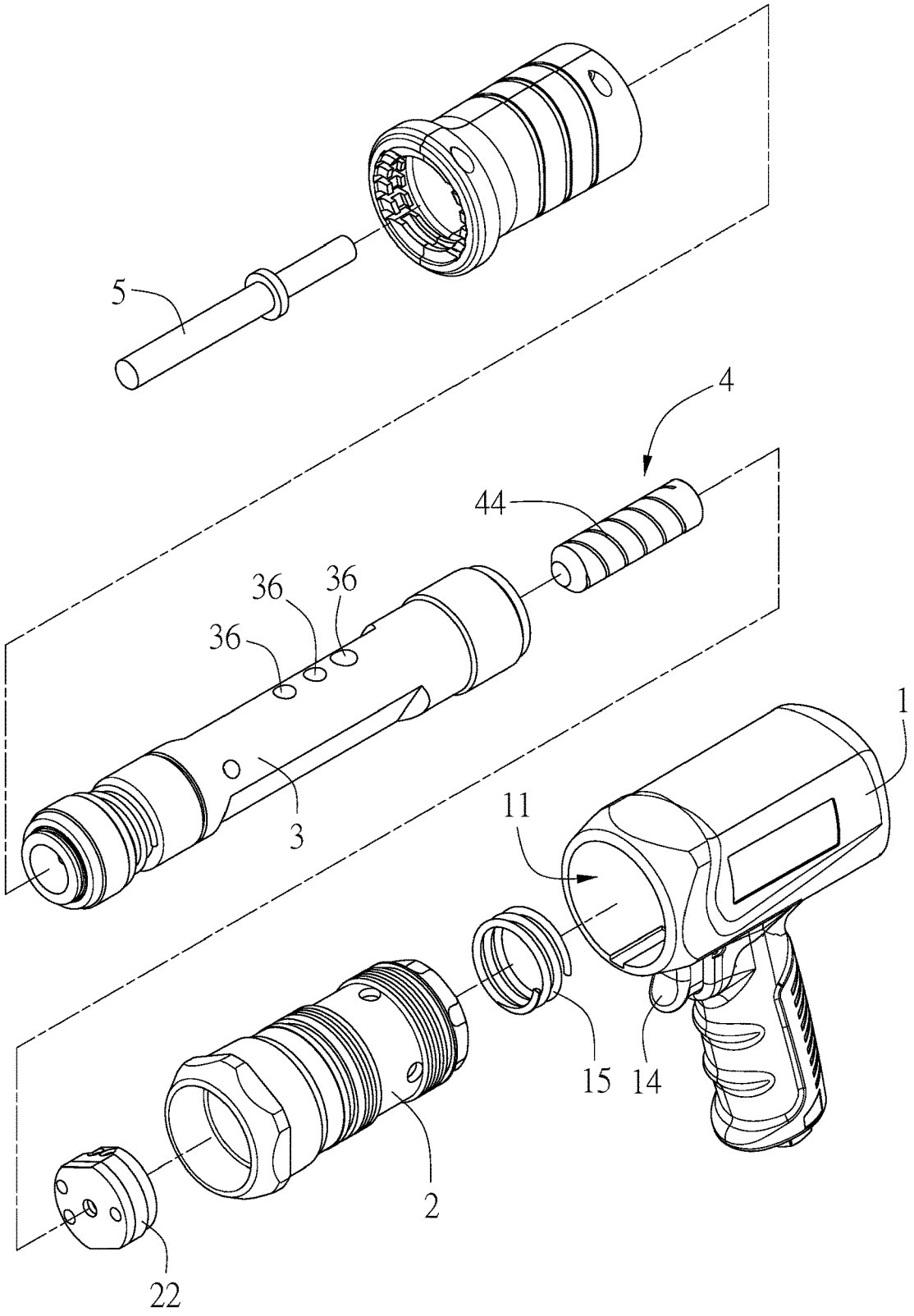
FIG. 1 is an exploded perspective view of a first embodiment according to the present invention.
Figure 2:
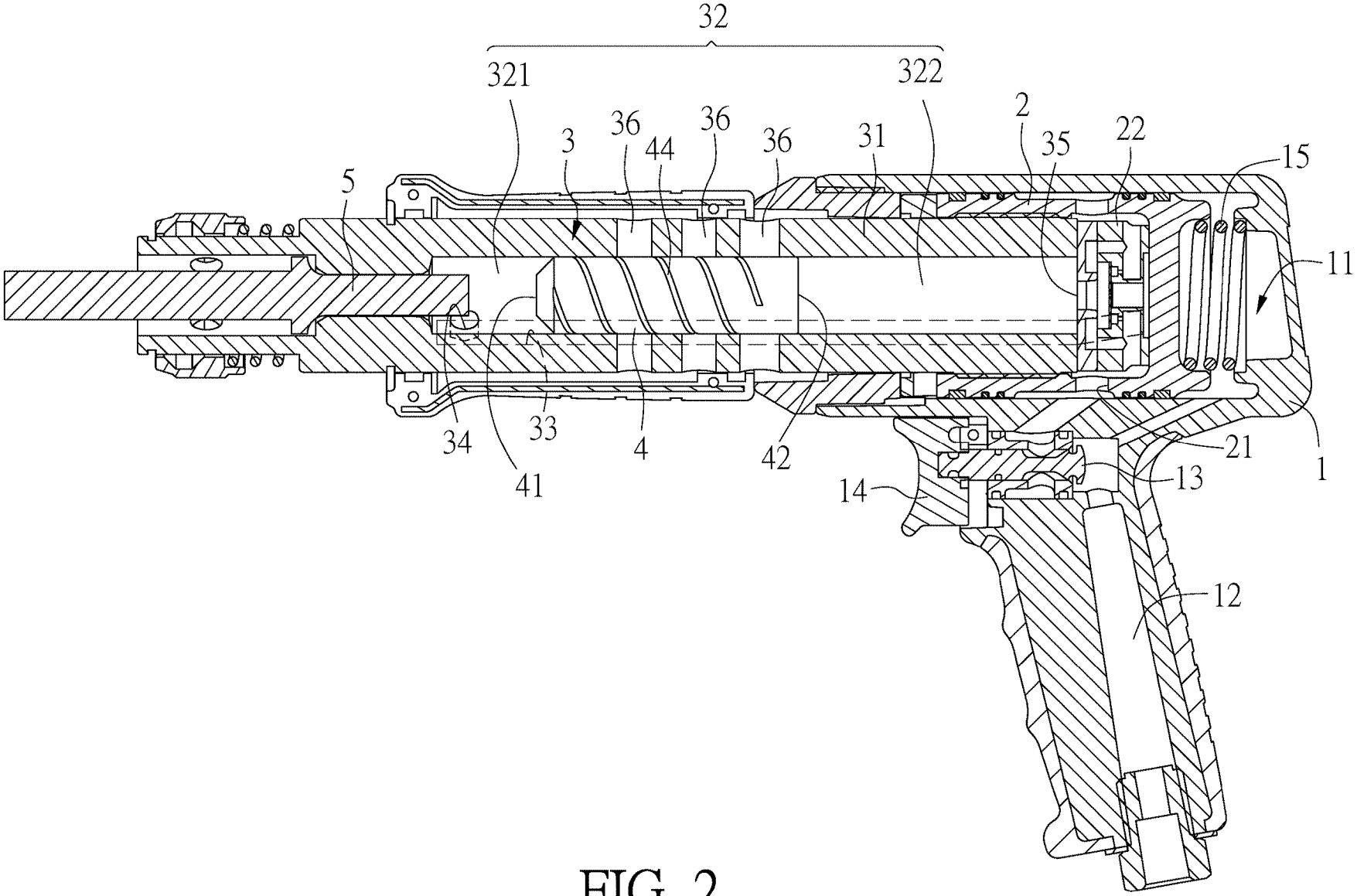
FIG. 2 is a sectional view of the first embodiment according to the present invention.

FIG. 1 and FIG. 2 show a first embodiment of the pneumatic impact tool having a vibration reducing structure according to the present invention. The pneumatic impact tool in the present invention includes a handle 1, a bucket member 2, a tube member 3 and a hammer member 4. The handle 1 may be formed in a shape of a gun or a cylinder. In this embodiment, the handle 1 is formed in a shape of a gun. A recess 11 is provided at top of the handle 1 while a gas supplying channel 12 communicated with the recess 11 is provided at bottom of the handle 1. A gas switch 13 is disposed in the gas supplying channel 12 to control gas flowing. A button 14 disposed on the handle 1 is connected with the gas switch 13 for operation.

In this embodiment, the bucket member 2 is accommodated in the recess 11. A spring 15 is provided at bottom of the recess 11 to cushion the bucket member 2. A side wall of the bucket member 2 is provided with a communicating hole 21 to communicate with the gas supplying channel 12. A conventional directional control valve 22 is fixed in the bucket member 2 to output the high pressure gas in two different paths.

The tube member 3 includes a cylindrical wall 31 and a chamber 32 surrounded by the cylindrical wall 31. One end of the cylindrical wall 31 extends into the bucket member 2 and is screwed to the bucket member 2. The hammer member 4 is movably accommodated in the chamber 32 and is closely engaged with the cylindrical wall 31. Accordingly, the chamber 32 is divided into a front chamber portion 321 and a rear chamber portion 322 by the hammer member 4.

A tool member 5 is fixed at a front end of the cylindrical wall 31 which sticks out of the bucket member 2, the tool member 5 being able to be replaced according to different needs. An interior of the cylindrical wall 31 is provided with a gas passing channel 33 communicating the directional control valve 22 and the front chamber portion 321. A first gas inlet 34 corresponding to the gas passing channel 33 is formed within the front chamber portion 321. A second gas inlet 35 in communication with the directional control valve 22 is disposed within the rear chamber portion 322. Therefore, the directional control valve 22 guides high pressure gas into the gas passing channel 33, and then gas enters the front chamber portion 321 through the first gas inlet 34, or at particular times the directional control valve 22 alter the gas to enter the rear chamber portion 322 through the second gas inlet 35.

Besides, at least one vent 36 configured to communicate the chamber 32 to the environment is disposed on the cylindrical wall 31. In this embodiment, three vents 36 with different distances to the tool member 5 are provided along the tube member 3. Furthermore, all the vents 36 are located between the first gas inlet 34 and the second gas inlet 35, and a maximum distance between the vents 36 and the tool member 5 is not greater than half a length of the chamber 32.

Figure 3:
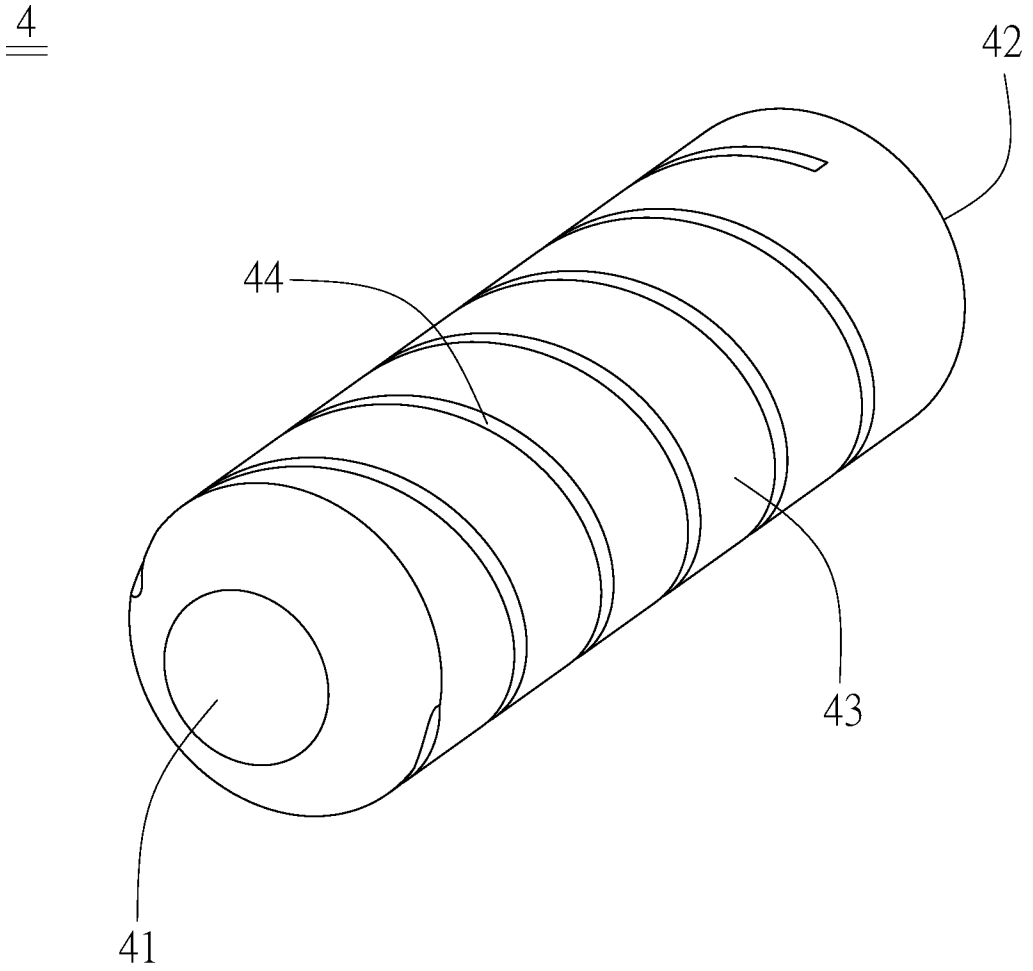
FIG. 3 is a perspective view of the hammer member of the first embodiment according to the present invention.

Referring to FIG. 2 and FIG. 3, the hammer member 4 includes a head portion 41 close to the first gas inlet 34, a tail portion 42 close to the second gas inlet 35 and an outer peripheral surface 43 therebetween. An outer diameter of the hammer member 4 is equal to an inner diameter of the chamber 32, so that the outer peripheral surface 43 is closely engaged with the cylindrical wall 31. The outer peripheral surface 43 is provided with an exhaust channel which extends to the head portion 41 to be in communication with the front chamber portion 321 and not extends to the tail portion 42 so as to lack in communication with the rear chamber portion 322. In this embodiment, the exhaust channel is formed as a helical groove 44 disposed around the hammer member 4 on the outer peripheral surface 43. More than one groove is more practical.

Figure 4:
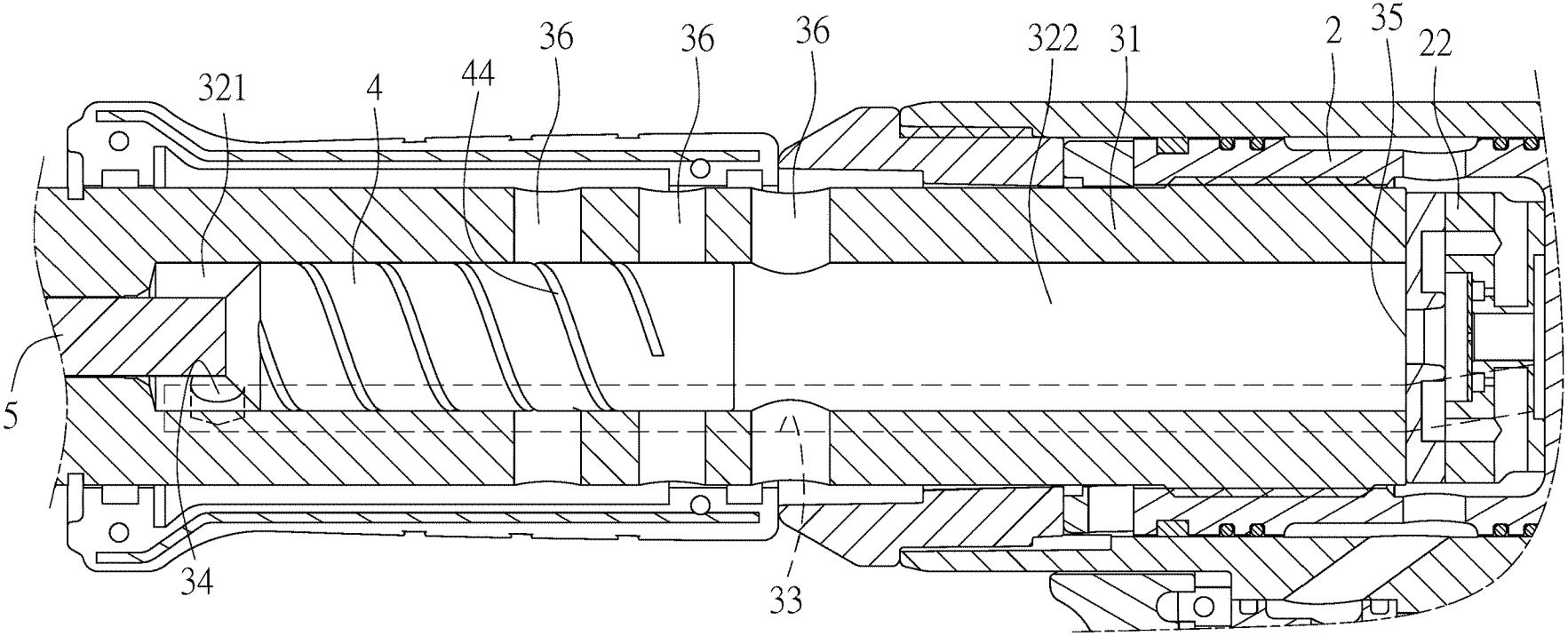
FIGS. 4-6 illustrate that how the first embodiment according to the present invention works.

In this embodiment, as shown in FIG. 4, the groove 44 communicates with one vent 36 which is closest to the tool member 5 and one next vent 36 when the hammer member 4 is at a position where to engage with the tool member 5.

After pressing the button 14 for operating the gas switch 13 to introduce high pressure gas into the directional control valve 22 through the gas supplying channel 12, the directional control valve 22 firstly guides the gas into the rear chamber portion 322 through the second gas inlet 35. So the gas pushes the hammer member 4 to move forward and hit the tool member 5. Then the gas delivering path is altered by the directional control valve 22. High pressure gas is guided into the gas passing channel 33 and enter the front chamber portion 321 through the first gas inlet 34, instead of guiding the gas into the rear chamber portion 322 through the second gas inlet 35. Since it is commonly known about how the directional control valve 22 alters the gas delivering path, description is omitted.

Continuously, gas starts to push the hammer member 4 to return. Referring to FIG. 4, due to communication between the groove 44 and the vents 36, gas is exhausted since the beginning of the returning process of the hammer member 4, and thus pressure in the front chamber portion 321 is decreased. Accordingly, a force pushing the hammer member 4 is weakened, and then causes less vibration when the hammer member 4 arrives at the rear end of the tube member 3.

It is emphasized that gas in the front chamber portion 321 starts to be exhausted since the beginning of the returning process of the hammer member 4 as a result of communication between the groove 44 and the vents 36. Compared to the conventional structure, gas is earlier to be exhausted in the present invention so that vibration is significantly reduced.

Figure 5:
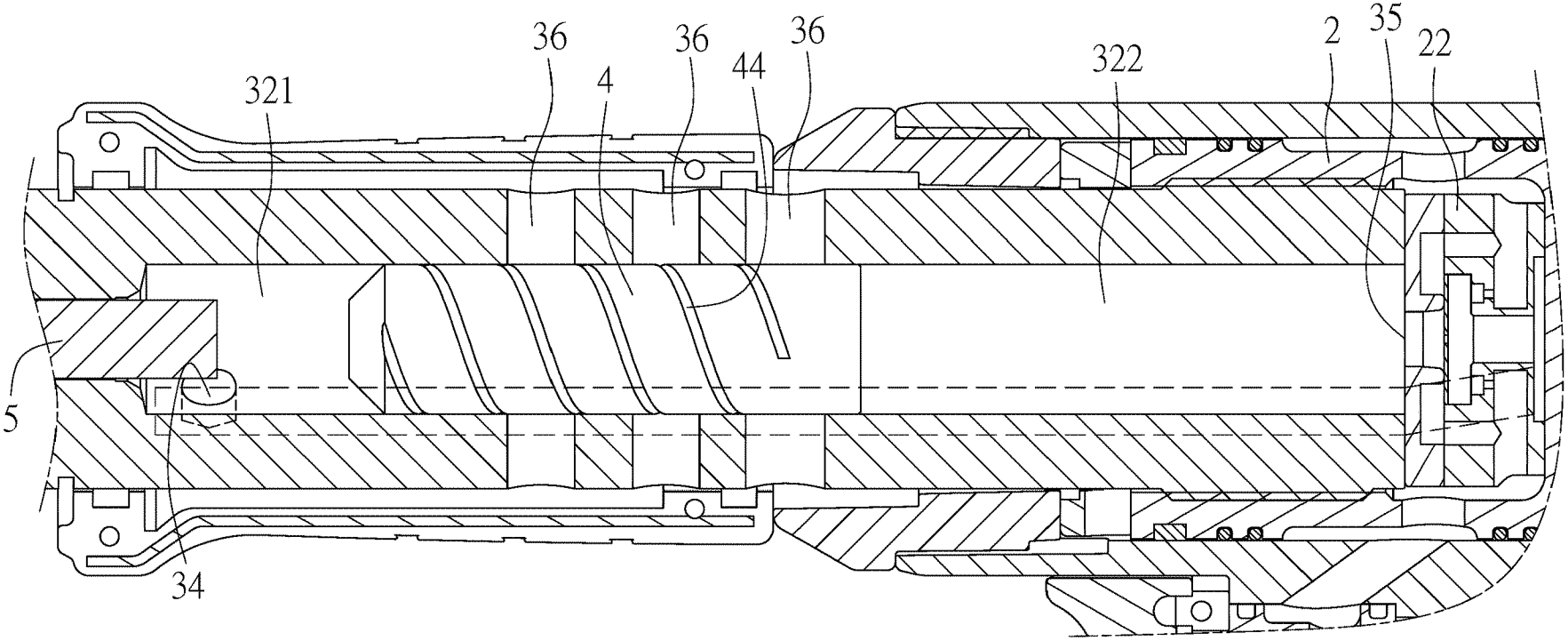
Figure 6:
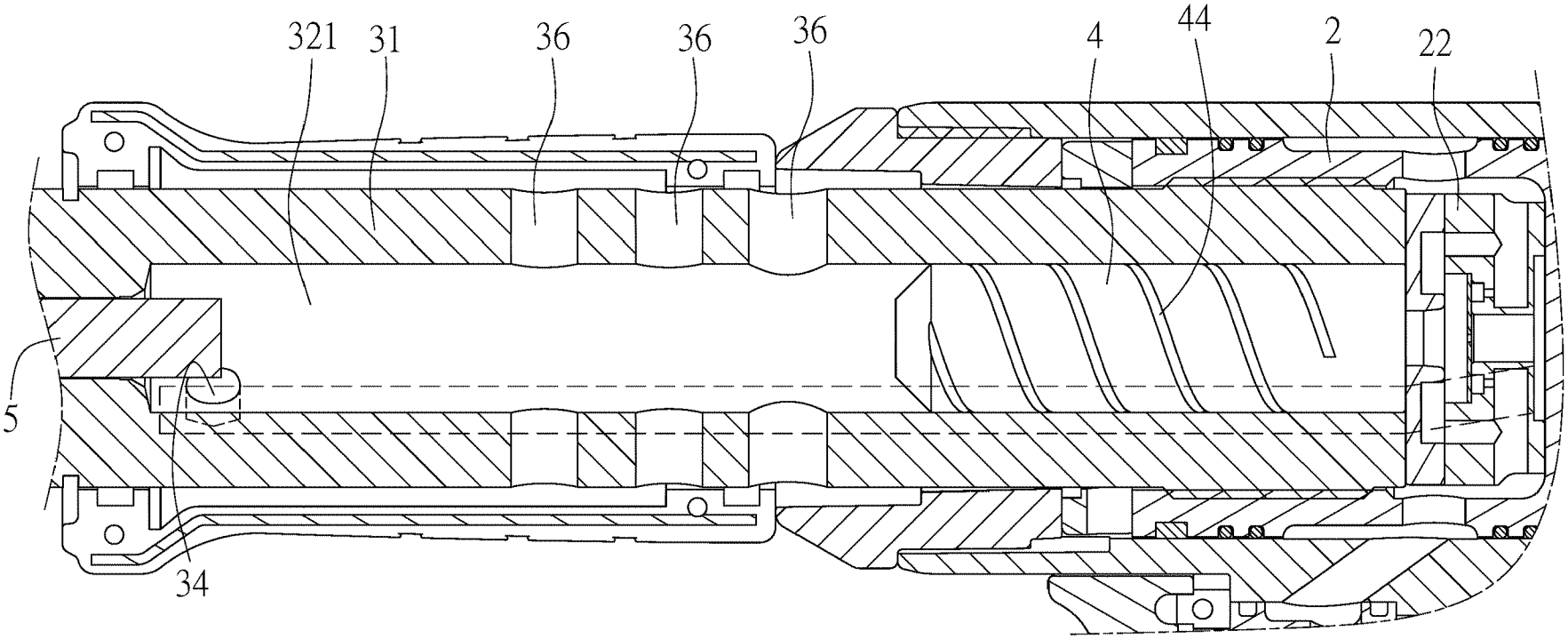

Further referring to FIG. 5, in the course of the returning process of the hammer member 4, the groove 44 communicates with different vents 36 so that gas is able to be exhausted for a long time. Therefore, the force pushing the hammer member 4 to return is continuously weakened to significantly reduce vibration.

The present invention features that the force pushing the hammer member 4 to return is directly weakened by gas exhausting to generate better effect upon vibration reduction. On the other hand, force generated by high pressure gas to hit the tool member is never affected so that the output power of the pneumatic impact tool is able to be kept.

Figure 7:
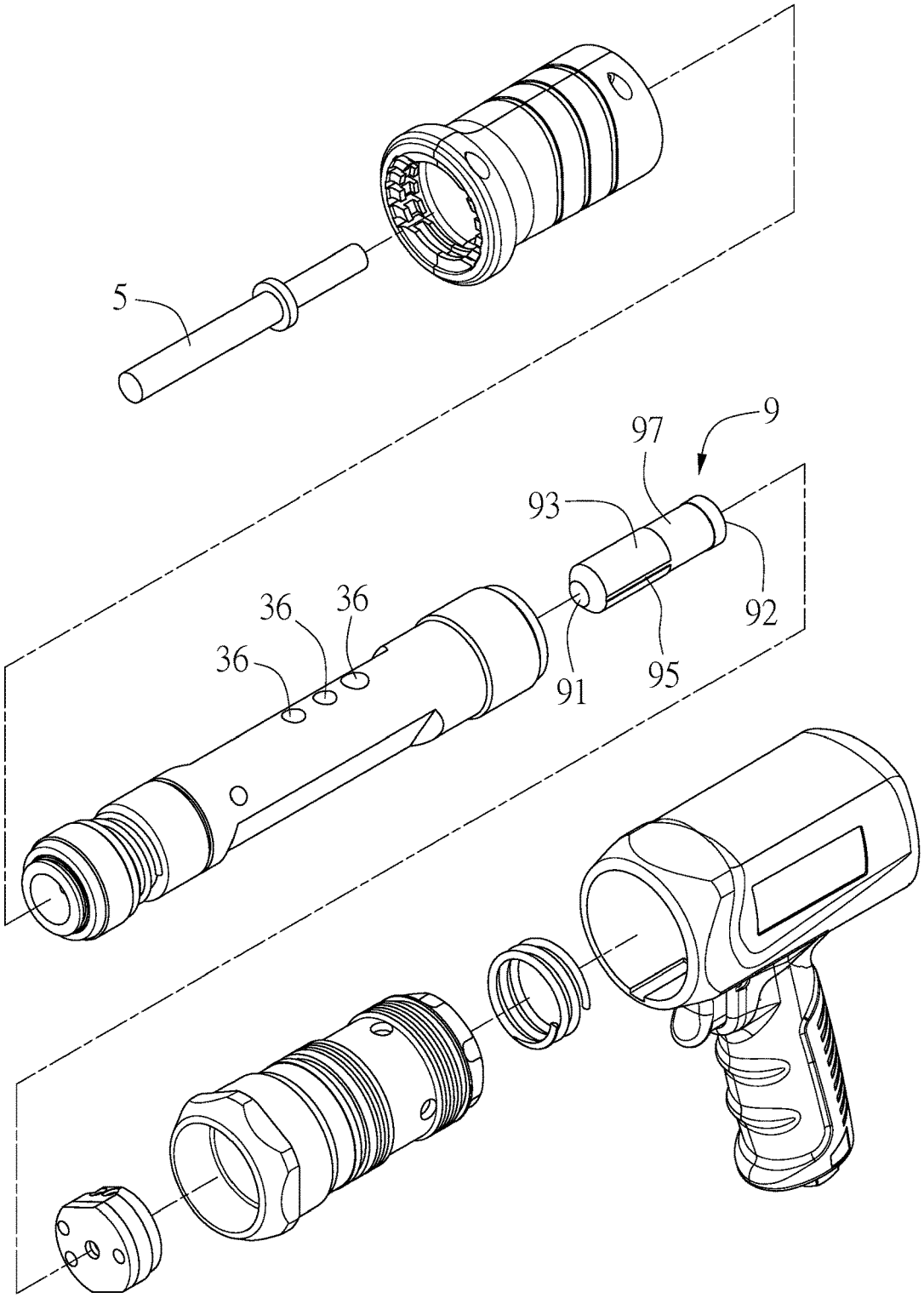
FIG. 7 is an exploded perspective view of a second embodiment according to the present invention.
Figure 8:
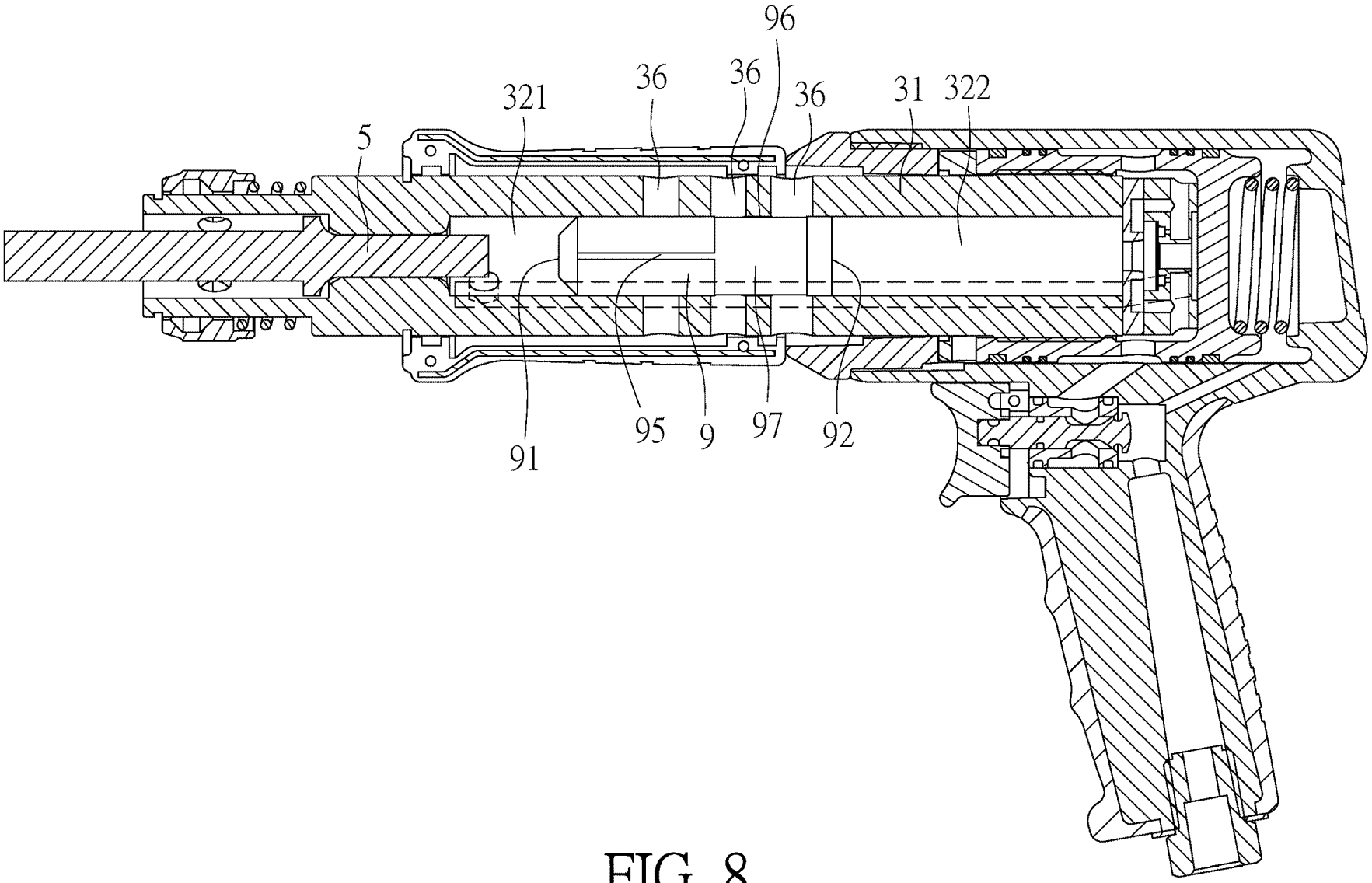
FIG. 8 is a sectional view of the second embodiment according to the present invention.
Figure 9:
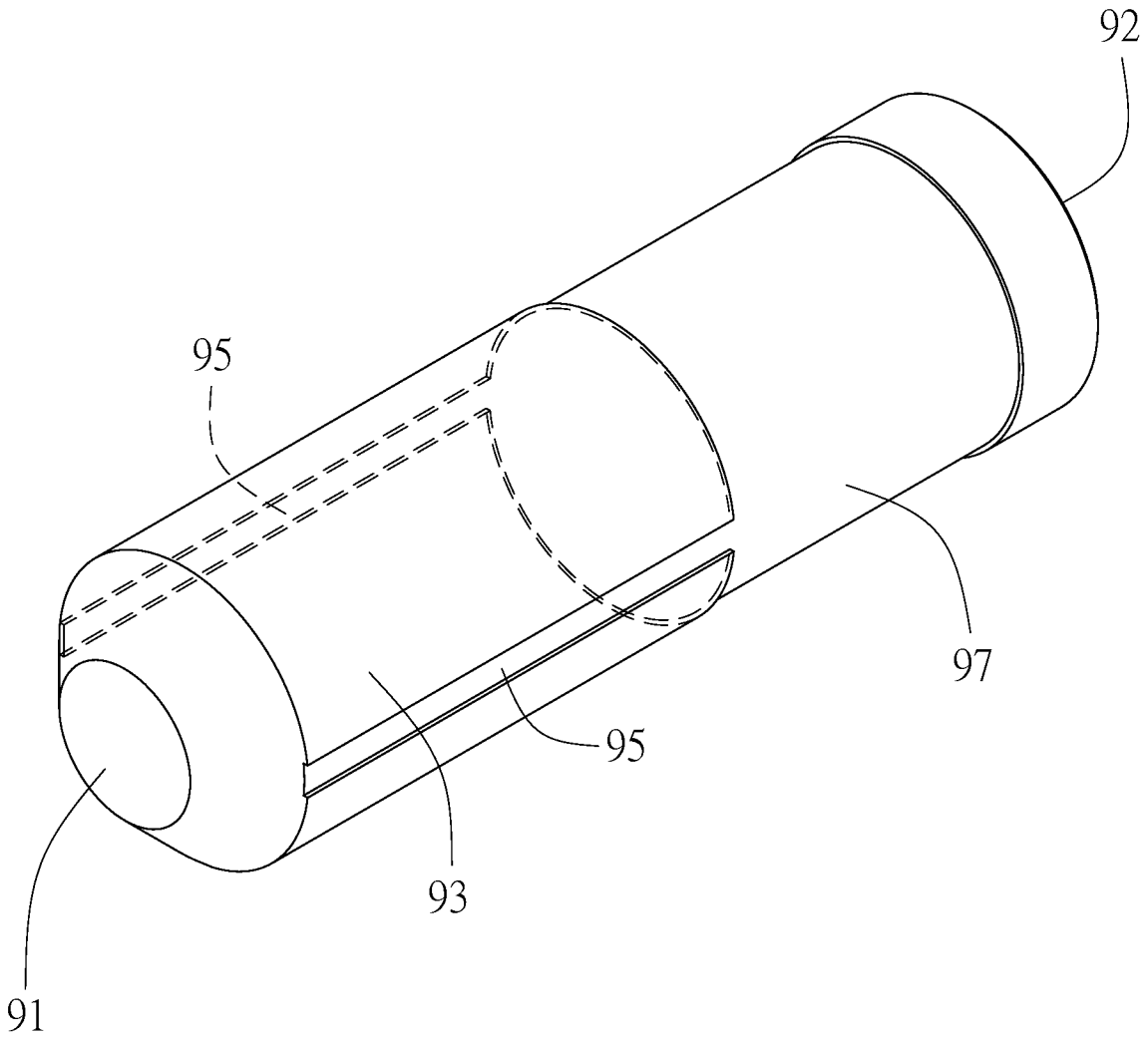
FIG. 9 is a perspective view of the hammer member of the second embodiment according to the present invention.

FIGS. 7-9 illustrate a second embodiment according to the present invention, which is similar to the previous embodiment. The only difference is the structure of the hammer member.

Referring to FIG. 9, the hammer member 9 includes a head portion 91, a tail portion 92 and an outer peripheral surface 93 therebetween. The outer peripheral surface 93 is provided with an exhaust channel which extends to the head portion 91 and not extends to the tail portion 92. In this embodiment, the exhaust channel includes a groove portion 95 and a cylindrical gap 96. The groove portion 95 extends in a straight direction parallel to a moving direction of the hammer member 9. One end of the groove portion 95 extends to the head portion 91 to be in communication with the front chamber portion 321 while the other end of the groove portion 95 is in communication with the cylindrical gap 96. The outer peripheral surface 93 is provided with a concave portion 97 which does not extend to the tail portion 92. A space between the concave portion 97 and the cylindrical wall 31 is defined as the said cylindrical gap 96.

Figure 10:
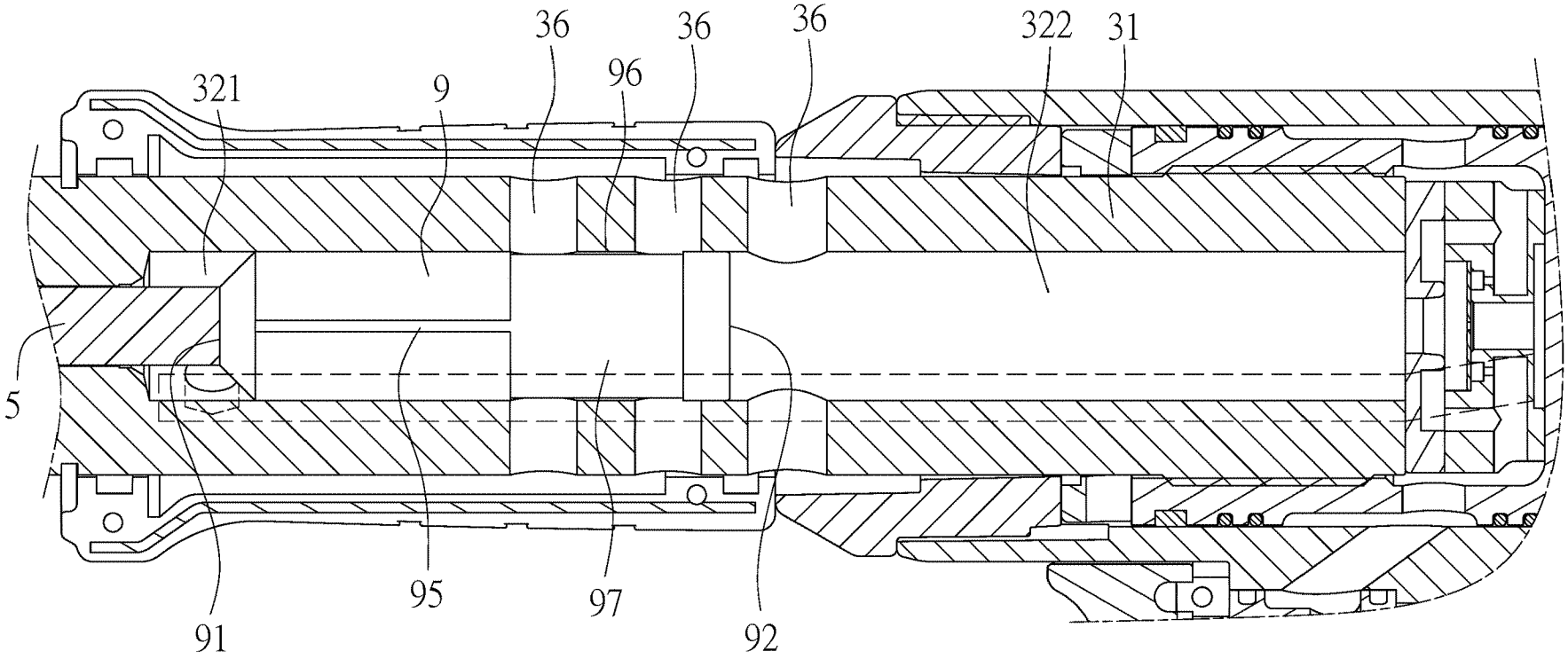
FIGS. 10-12 illustrate that how the second embodiment according to the present invention works.

As shown in FIG. 10, the cylindrical gap 96 communicates with one vent 36 which is closest to the tool member 5 and one next vent 36 when the hammer member 9 is at a position where to engage with the tool member 5.

Figure 11:
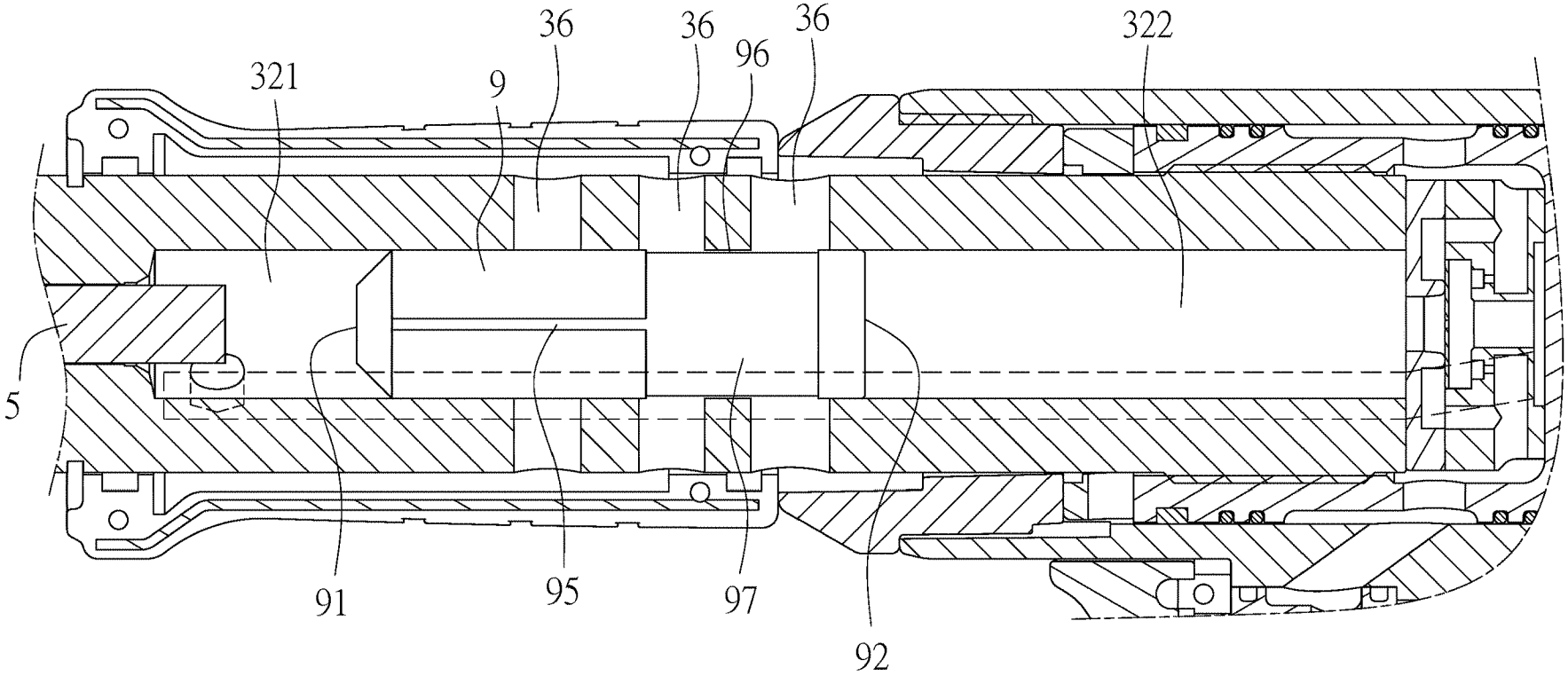
Figure 12:
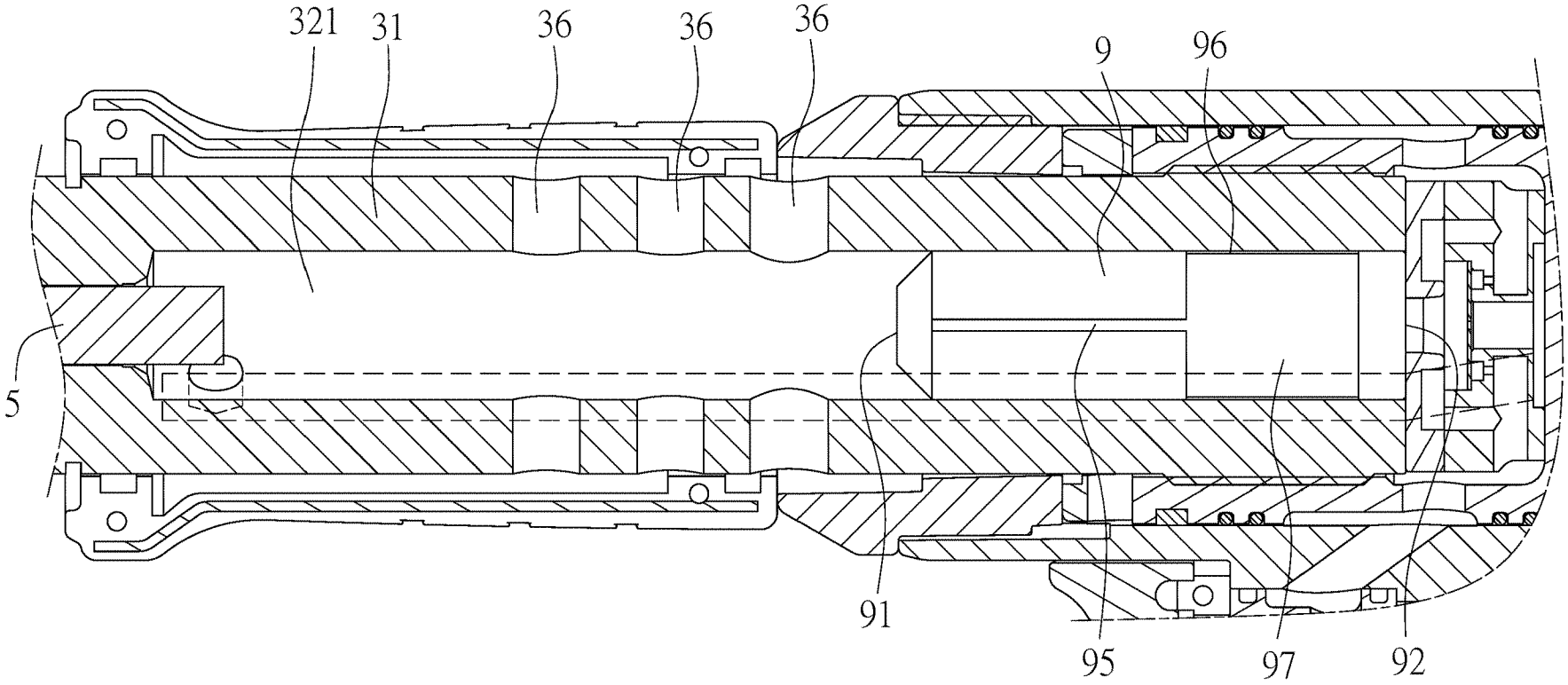

Like the previous embodiment, due to communication between the cylindrical gap 96 and the vents 36, gas is exhausted since the beginning of the returning process of the hammer member 9, and thus pressure in the front chamber portion 321 is decreased. Compared to the conventional structure, gas is earlier to be exhausted in the present invention. Further referring to FIG. 11, in the course of the returning process of the hammer member 9, the cylindrical gap 96 communicates with different vents 36 so that gas is able to be exhausted for a long time. Therefore, the force pushing the hammer member 9 to return is continuously weakened to significantly reduce vibration.

What is claimed is:

1. A pneumatic impact tool having a vibration reducing structure comprising:

a handle with a recess and a gas supplying channel communicated with the recess, wherein the gas supplying channel is provided with a gas switch;

a bucket member accommodated in the recess, a communicating hole being disposed on a side wall of the bucket member for guiding high pressure gas from the gas supplying channel into a directional control valve fixed in the bucket member;

a tube member including a cylindrical wall coupled with the bucket member and a chamber surrounded by the cylindrical wall, the chamber being divided into a front chamber portion and a rear chamber portion by a hammer member which is disposed in the chamber and closely engaged with the cylindrical wall, a tool member being disposed at a front end of the cylindrical wall, at least one vent being disposed on the cylindrical wall to communicate the chamber to an environment, a gas passing channel communicating the directional control valve and the front chamber portion being disposed in the cylindrical wall, the gas passing channel having a first gas inlet which is formed within the front chamber portion, a second gas inlet in communication with the directional control valve being provided within the rear chamber portion, wherein gas may be selectively guided into the front chamber portion through the first gas inlet or into the rear chamber portion through the second gas inlet;

wherein an exhaust channel is disposed on an outer peripheral surface of the hammer member, the hammer member including a head portion close to the first gas inlet and a tail portion close to the second gas inlet, wherein the exhaust channel extends to the head portion to be in communication with the front chamber portion, along with that the exhaust channel does not extend to the tail portion so as to lack in communication with the rear chamber portion;

wherein the hammer member is pushed by high pressure gas to move toward the tool member if high pressure gas is guided into the rear chamber portion through the second gas inlet;

wherein the hammer member is pushed by high pressure gas to move away from the tool member if high pressure gas is guided into the front chamber portion through the first gas inlet, and high pressure gas in the front chamber portion is exhausted through the exhaust channel and the at least one vent to lower a force pushing the hammer member when the exhaust channel communicates with the at least one vent.

2. The pneumatic impact tool of claim 1, wherein the exhaust channel is formed as a helical groove disposed on the outer peripheral surface of the hammer member.

3. The pneumatic impact tool of claim 2, wherein the groove communicates with the at least one vent when the hammer member engages with the tool member.

4. The pneumatic impact tool of claim 2, wherein three said vents with different distances to the tool member are disposed on the cylindrical wall.

5. The pneumatic impact tool of claim 4, wherein the groove communicates with one said vent which is closest to the tool member and one next said vent when the hammer member is at a position where to engage with the tool member.

6. The pneumatic impact tool of claim 1, wherein the exhaust channel includes a groove portion and a cylindrical gap in communication with each other, the groove portion extending in a straight direction parallel to a moving direction of the hammer member to the head portion to be in communication with the front chamber portion, the cylindrical gap being formed as a space between a concave portion disposed on the outer peripheral surface of the hammer member and the cylindrical wall.

7. The pneumatic impact tool of claim 6, wherein the cylindrical gap communicates with the at least one vent when the hammer member engages with the tool member.

8. The pneumatic impact tool of claim 6, wherein three said vents with different distances to the tool member are disposed on the cylindrical wall.

9. The pneumatic impact tool of claim 8, wherein the cylindrical gap communicates with one said vent which is closest to the tool member and one next said vent when the hammer member is at a position where to engage with the tool member.

10. The pneumatic impact tool of claim 1, wherein a distance between the at least one vent and the tool member is not greater than half a length of the chamber.

* * * * *